United States Patent [19]

MacPherson

[11] 4,409,923

[45] Oct. 18, 1983

[54] MARINE ANCHOR

[76] Inventor: David B. MacPherson, 15 Potter St., Brunswick, Me. 04011

[21] Appl. No.: 275,196

[22] Filed: Jun. 19, 1981

[51] Int. Cl.[3] ..... B63B 21/44

[52] U.S. Cl. ..... 114/304; 114/309

[58] Field of Search ..... 219/158; 114/298-309

[56] References Cited

U.S. PATENT DOCUMENTS

| | | | |
|---|---|---|---|
| 2,352,697 | 7/1944 | Dittrich | 219/158 |
| 3,291,093 | 12/1966 | Wood | 114/310 |
| 3,373,712 | 3/1968 | Stokes | 114/310 |
| 3,757,727 | 9/1973 | Hungerford | 114/304 |
| 4,073,256 | 2/1978 | Rossini | 114/306 |

*Primary Examiner*—Trygve M. Blix
*Assistant Examiner*—Thomas J. Brahan
*Attorney, Agent, or Firm*—Frijouf, Rust & Pyle

[57] ABSTRACT

An improved marine anchor is disclosed for anchoring a marine vessel with an anchor rode. The anchor comprises a first and a second fluke connected to an anchor stock. An anchor shank has a pivot aperture disposed between a head portion and a tail portion of the anchor shank. The tail portion of the anchor shank may be provided with either an aperture or a slip ring for connecting to the anchor rode. The pivot aperture pivots the anchor shank on the anchor stock in a space between the first and second flukes. The improvement comprises a novel anchor crown secured to the anchor stock to limit the pivotal movement of the anchor shank upon contact of the head portion of the anchor shank with the anchor crown.

7 Claims, 9 Drawing Figures

MARINE ANCHOR

BACKGROUND OF THE INVENTION

1. Field of the Invention

This invention relates to ships and more particularly to anchors having pivoted flukes.

2. Description of the Prior Art

Throughout maritime history, various types of anchors have been devised in an effort to provide a lightweight and strong anchor having a high holding power. The earliest anchors were relatively heavy with rigid flukes and rigid perpendicular stocks, enabling the flukes of the anchor to bury into the sea bed to increase the holding power thereof.

The stockless or navy type anchor was the first anchor incorporating flukes that were movable relative to the anchor shank. However, the flukes of the navy type anchor were heavy and thus the anchor was used only on large ships. The concept of a movable fluke anchor led to the development of the wishbone anchor as well as the plow anchor.

In 1939, the first lightweight movable fluke anchor was invented and characterized as a stock stabilized pivoting fluke anchor. This anchor is presently sold under the trademark "DANFORTH" which is a registered trademark of The Eastern Company. With the stock stabilized movable fluke anchor, large lightweight flukes were secured to the anchor stock with the anchor shank being pivoted on the anchor stock between the large flukes. An anchor crown was secured to the stock and the flukes to limit the pivotal movement of the anchor shank. In addition, the anchor crown was designed to lift the base of the flukes to insure that the fluke points would bury in the sea bed. The art soon realized the tremendous holding power to anchor weight ratio of the stock stabilized pivoting fluke anchor. The holding power of this anchor was determined primarily by the physical design and size of the component parts rather than the weight of the anchor. The action of the anchor crown of the stock stabilized pivoting fluke anchor required critical tolerances and a relatively complex assembly in comparison to the anchors of the prior art. In general, the anchor crown included plural crown plates secured to the flukes and the anchor stock for controlling the lateral stability of the anchor shank. In addition, crown tops were disposed upon the ends of the crown plates for limiting the pivotal movement of the anchor shank. The crown tops were inclined by virture of the shape of the crown plates to provide the desired lifting action of the base of the flukes to embed the fluke points into the sea bed. High strength anchor versions of the stock stabilized pivoting fluke anchor also included a shank stop secured to the anchor crown for increasing the load capability of the anchor.

The stock stabilized pivoting fluke anchors have been widely accepted and copied by others since the first introduction in the marketplace.

Some in the prior art have attempted to simplify the anchor to provide a low cost anchor relative to the cost of the stock stabilized pivoting fluke anchors originally sold under the trademark "DANFORTH". Unfortunately, these anchors do not have an anchor crown secured to the anchor stock for movement in unison with the anchor flukes. Accordingly, the performance of these anchors is substantially reduced since the anchor crown does not force the fluke points into the sea bed. Accordingly, there is a need in the present anchor art to provide a low cost stock stabilized pivoting fluke anchor which may be manufactured at less cost than the standard anchor of this design while still maintaining the basic design concept of the stock stabilized pivoting fluke type anchor.

Therefore it is an object of this invention to provide an apparatus which overcomes the aforementioned inadequacies of the prior art devices and provides an improvement which is a significant contribution to the advancement of the anchor art.

Another object of this invention is to provide an improved marine anchor for anchoring a marine vessel having an improved anchor crown resulting in a low cost anchor while still maintaining the desired effects of the traditional stock stabilized pivoting fluke type anchor.

Another object of this invention is to provide an improved marine anchor for anchoring a marine vessel wherein the number of parts of the anchor crown is substantially reduced thus reducing the overall number of parts of the improved marine anchor.

Another object of this invention is to provide an improved marine anchor for anchoring a marine vessel wherein the anchor may be easily assembled in one operation without the requirement of sub-assemblies.

Another object of this invention is to provide an improved marine anchor for anchoring a marine vessel having a high holding power to anchor weight ratio.

Another object of this invention is to provide an improved marine type anchor for a marine vessel having a novel and low cost anchor shank.

Another object of this invention is to provide an improved marine type anchor for a marine vessel wherein the anchor shank has a head portion and a tail portion with the pivotal movement of the anchor shank controlled by the anchor crown in cooperation with the head portion of the anchor shank.

The foregoing has outlined some of the more pertinent objects of the invention. These objects should be construed to be merely illustrative of some of the more prominent features and applications of the intended invention. Many other beneficial results can be attained by applying the disclosed invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The invention is defined by the appended claims with a specific embodiment shown in the attached drawings. For the purpose of summarizing the invention, the invention may be incorporated into an improved marine anchor for anchoring a marine vessel with an anchor rode comprising a first and a second fluke connected to an anchor stock with the first and second flukes having a space disposed therebetween. An anchor shank is provided with a pivot aperture between a head portion and a tail portion of the anchor shank. Rode means is provided to receive the anchor rode at the tail portion of the anchor shank. The pivot aperture pivots the anchor shank on the anchor stock in the space between the first and second flukes. An anchor crown means is secured to the anchor stock to limit the pivotal movement of the anchor shank upon contact of the head portion of the anchor shank with the anchor crown means.

In a more specific embodiment of the invention, the anchor crown means comprises plural end regions extending in a direction generally opposite to the direction of the flukes to limit the pivotal movement of the anchor shank upon contact between the head portion of the end regions. Preferably, the anchor crown means comprises a unitary element having plural bends for defining the end regions from a central region. An elongated crown aperture is disposed within the central region of the anchor crown means to limit the lateral movement of the anchor shank on the anchor stock. The novel anchor crown means provides a one-piece anchor crown in lieu of the four piece anchor crown of the prior art standard anchor and the six piece anchor crown of the high strength anchor.

The foregoing invention is compatible for use with either a rode aperture disposed at the distal end of the tail portion of the anchor shank or a rode fastener such as a ring slidably engaged with the slot extending along the longitudinal length of the anchor shank. In the latter configuration, the anchor shank may be formed from a shank rod having a first and a second end with a substantially one hundred and eighty degree bend therebetween forming a first and a second leg. First means interconnect the first and second ends of the shank rod creating the head portion of the anchor shank. The second means interconnects the first and second legs of the shank rod forming the pivot aperture between the first and second interconnecting means of the shank rod.

The invention is constructed by positioning the plural flukes such as by placing the plural flukes in a holding jig. The anchor crown is then positioned between the plural flukes and the anchor stock is inserted through the pivot aperture of the shank. The tail portion of the anchor shank is inserted through the crown aperture and the flukes and anchor crown are welded to the anchor stock.

In one embodiment of the invention, the anchor shank is formed by bending an anchor shank rod to form a first and a second leg generally parallel to one another with the terminal ends of the legs being adjacent one another. The terminal ends of the first and second legs are then welded to be in a fixed spatial relationship to one another with a second weld interconnecting the first and second legs forming the pivot aperture between the plural welds.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
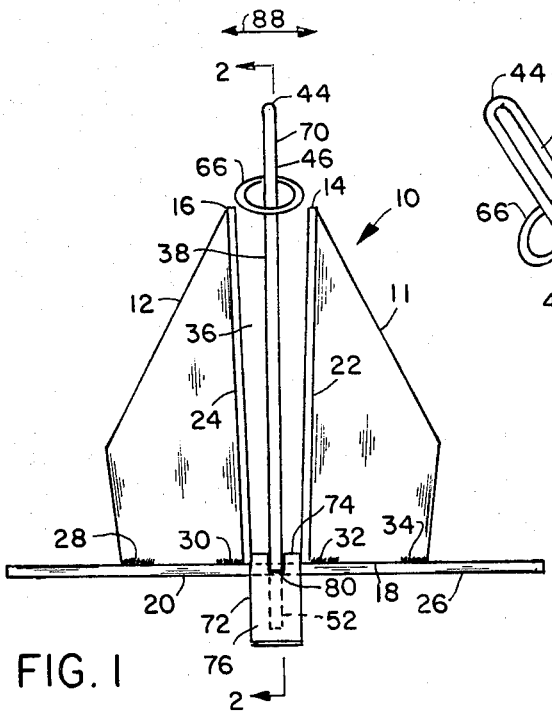
FIG. 1 is a front elevational view of a first embodiment of the improved marine anchor.
Figure 2:
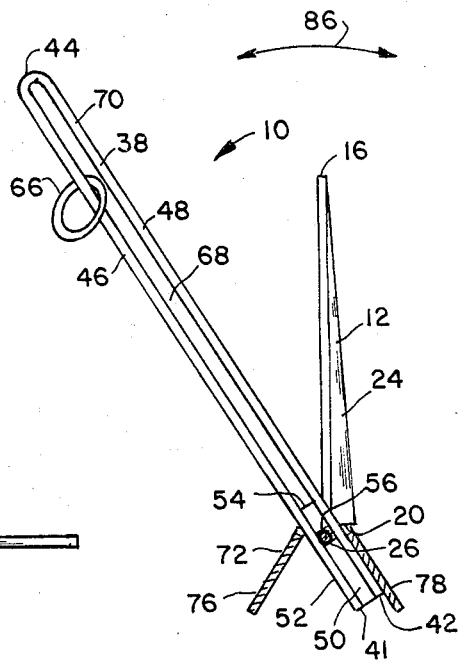
FIG. 2 is a side sectional view along line 2—2 in FIG. 1.

FIGS. 1 and 2 illustrate a first embodiment of an improved marine anchor 10 of the type characterized as a stock stabilized pivoting fluke anchor. The anchor 10 comprises a first and a second fluke 11 and 12, respectively having fluke points or tips 14 and 16 and fluke bases 18 and 20. In addition, each of the flukes 14 and 16 includes a support member 22 and 24 for adding mechanical strength to the flukes in addition to facilitating connection to an anchor stock 26.

The flukes 11 and 12 are secured to the anchor stock 26 by welds 28, 30, 32 and 34, with an equal number of welds (not shown) disposed on the rear side of the anchor shown in FIG. 1. It should be appreciated by those skilled in the art that the position and number of welds in the preferred embodiment are set forth only by way of example and that numerous other variations in the attachment may be utilized without departing from the invention as set forth herein.

The first and second flukes 11 and 12 are secured to provide a space 36 therebetween for receiving an anchor shank 38. The anchor shank 38 as more fully shown in FIGS. 2, 5 and 6, comprises a shank rod having a first and a second end 41 and 42 with a substantially one hundred and eighty degree bend 44 therebetween forming a first and a second leg 46 and 48. A first interconnecting means 50 such as a short section of the same material as the shank rod interconnects the first and second ends 41 and 42 creating a head portion 52 of the anchor shank 38. A second interconnection means 54, such as a short section of the same material as a shank rod interconnects the first and second legs 46 and 48 to form the pivot aperture 56 between the first and second interconnecting means 50 and 54. Preferably, the first and second interconnecting means are secured by welds 58, 60, 62 and 64 in FIG. 6.

Rode attachment means is shown in this embodiment as a ring 66 is slidably received within a longitudinally extending slot 68 between the first and second legs 46 and 48 at a tail portion 70 of the anchor shank 38 which tail portion extends above the pivot aperture 56. It should be appreciated by those skilled in the art that the anchor shank 38 as set forth in FIGS. 1, 2, 5 and 6 provides a low cost and easily fabricated anchor shank for the present invention.

Figure 5:
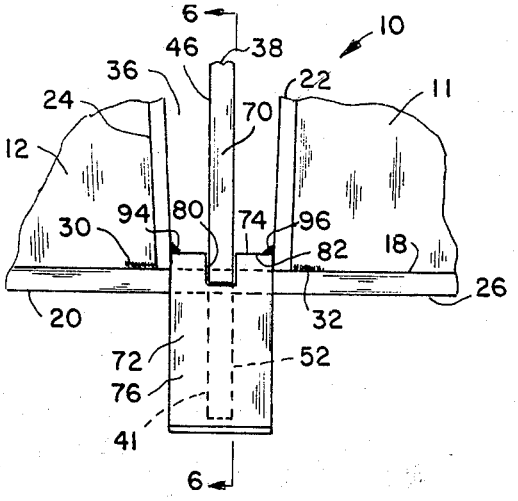
FIG. 5 is an enlarged partial front elevational view of the anchor shown in FIG. 1.
Figure 6:
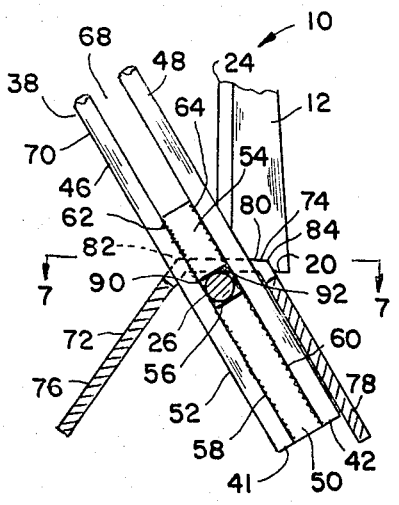
FIG. 6 is a sectional view along line 6—6 in FIG. 5.
Figure 7:
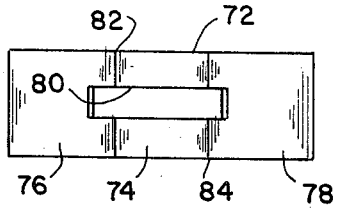
FIG. 7 PRIOR ART
FIG. 7 is a sectional view along line 7—7 in FIG. 6 showing only the anchor crown.

An important aspect of the present invention includes an anchor crown means 72 secured to the anchor stock 26 to limit the pivotal movement of the anchor shank 38 upon contact with the head portion 52 of the anchor shank 38. The anchor crown means, which is shown in FIGS. 1, 2, 5, 6 and 7, comprises a central region 74 and first and second end regions 76 and 78 with an elongated crown aperture or slot 80 disposed in at least the central region 74 of the anchor crown 72. Preferably, the anchor crown 72 comprises a unitary piece of material having first and second bends 82 and 84 for defining the first and second end regions 76 and 78, respectively, to limit the pivotal movement of the anchor shank 38 to preferably thirty-two degrees from the upright position as shown by the arrow 86 in FIG. 2. The elongated crown aperture 80 also limits the lateral movement of the anchor shank 38 as illustrated by the arrow 88 in FIG. 1. The anchor crown means 72 is secured to the anchor stock 26 by plural welds 90 and 92 shown in FIG. 6 in addition to being secured to the flukes 11 and 12 by welds 94 and 96 as shown in FIG. 5. The anchor shank 38 extends through the crown aperture 80 with the first and second end regions 76 and 78 extending in a direction generally opposite to the direction of the flukes 11 and 12. The central region 74 of the anchor crown 72 is disposed in the space 36 between the flukes 11 and 12 with the anchor stock 26 being disposed between the end regions 76 and 78. The anchor crown 72 moves in unison with the anchor flukes 11 and 12 and the anchor stock 26 for enabling the anchor crown 72 to aid the penetration of the fluke points 14 and 16 into the sea bed. Accordingly, the improved marine anchor has the identical characteristics of the popular stock stabilized pivoting fluke anchor but with a substantially simplified anchor crown, thus reducing the number of parts and the complexity of fabrication in comparison to the prior art anchors.

Figure 8:
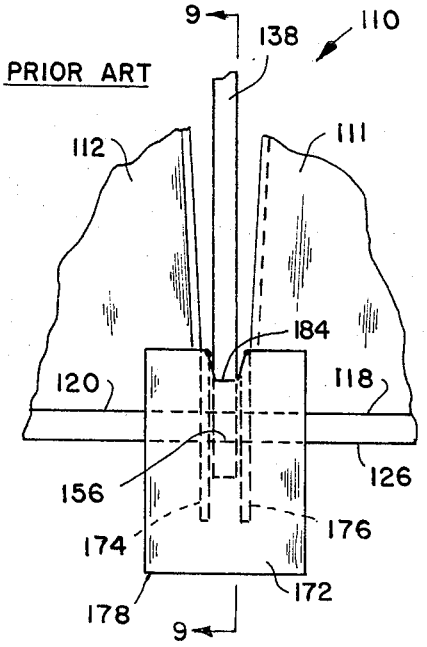
FIG. 8 PRIOR ART
FIG. 8 is a partial front elevational view of a prior art anchor.
Figure 9:
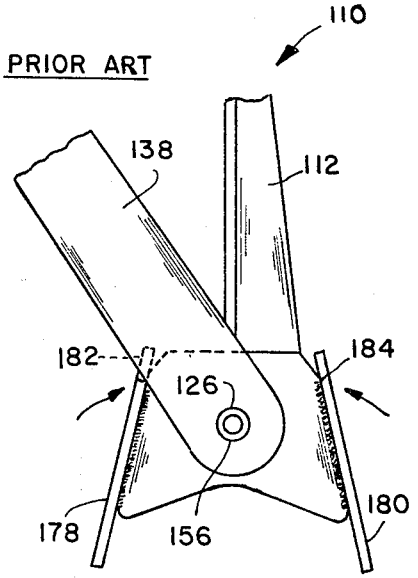
FIG. 9 is a sectional view along line 9—9 of FIG. 8.

The simplicity of the present design may be readily appreciated in comparison to the prior art anchor shown in FIGS. 8 and 9. In the prior art marine anchor 110, the flukes 111 and 112 have the bases thereof 118 and 120, secured to the anchor stock 126 by conventional means such as welding, not shown. The anchor shank 138 is provided on the anchor stock 126 through a pivot aperture 156 disposed in the anchor shank 138. The anchor crown 172 comprises crown plates 174 and 176 secured to the anchor stock 126 and the flukes 111 and 112 by welds (not shown). Plural crown tops 178 and 180 are welded to opposed ends of the crown plates 174 and 176 with each crown top 178 and 180 having a slot 182 and 184. The crown top slots 182 and 184 engage the anchor shank 138 to limit the pivotal movement of the anchor shank. In contrast, the present invention limits the pivotal movement of the anchor shank 38 by contact of the head portion 52 with the first and second end regions 76 and 78. Accordingly, the prior art anchor crown required two crown plates 174 and 176 and two crown tops 178 and 180 with slots 182 and 184 disposed in the crown tops 178 and 180. In addition, the anchor crown could not be easily manufactured with the remainder of the anchor due to the multiplicity of welds thereby requiring the anchor crown to be fabricated in a sub-assembly. The advantages of the present invention should be apparent in the replacement of the prior art plural crown plates and the prior art plural crown tops by a single unitary structure having an elongated aperture and plural bends.

Accordingly, the invention is manufactured by positioning the plural flukes 11 and 12 into a fixture such as a holding jig or the like. The crown means 72 is then positioned between the plural flukes 11 and 12 within the holding jig. The anchor stock 26 is then inserted through the pivot aperture 56 and the tail portion 70 of the anchor shank 38 is inserted into the elongated crown aperture 80. The flukes 11 and 12 and the anchor crown 72 are then welded to the anchor stock 26. The anchor crown 72 is also welded to the support members 22 and 24 of the flukes 11 and 12.

The anchor shank 38 shown in FIGS. 1, 2, 5 and 6 is fabricated by bending the anchor shank rod to form the first and second legs 46 and 48 to be generally parallel to one another, with the terminal ends 41 and 42 thereof being adjacent one another. The terminal ends 41 and 42 of the first and second legs 46 and 48 are then welded in a fixed spatial relationship to one another, preferably through the first interconnecting means 50. The first and second legs are again welded at a second location to be in a fixed spatial relationship through the second interconnecting means 54 forming the pivot aperture 56 between the plural welds.

Figure 3:
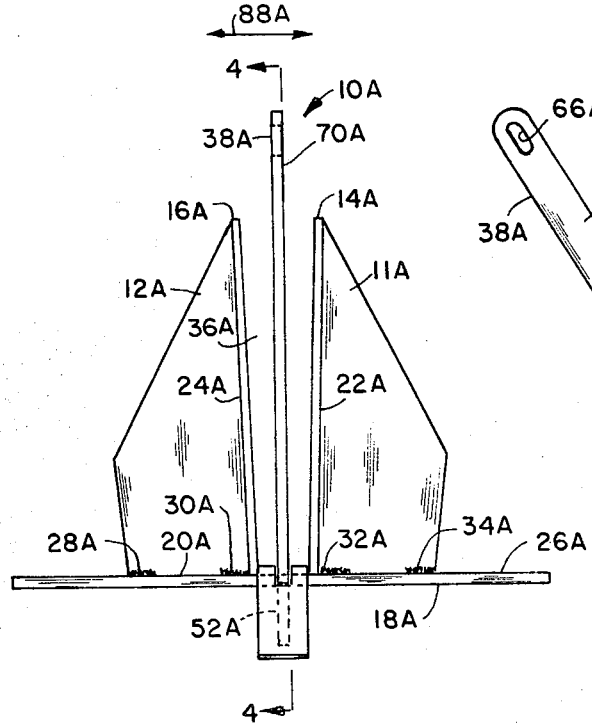
FIG. 3 is a front elevational view of a second embodiment of the improved marine anchor.
Figure 4:
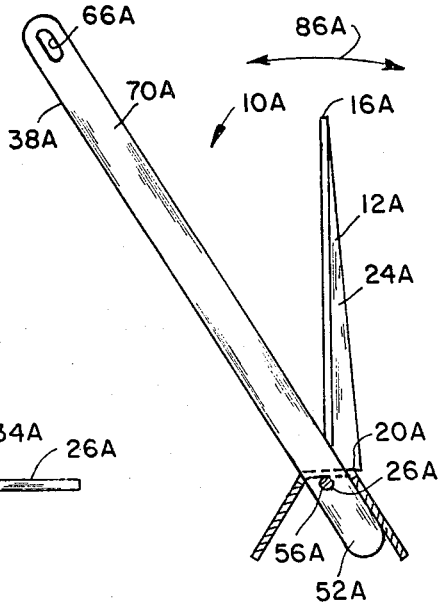
FIG. 4 is a sectional view along line 4—4 of FIG. 3.

The invention may also be incorporated into various types anchors and should not be construed to be limited to the embodiments set forth in FIGS. 1, 2, 5, 6 and 7. FIGS. 3 and 4 illustrate a second embodiment of the invention comprising a marine anchor 10A with similar parts being labeled with similar reference numerals followed by an A. In this embodiment, the anchor shank 38A has rode means comprising a through aperture 66A disposed in the tail portion 70A for attachment to a rode. The anchor shank 38A may be fabricated from bar stock, forged material or the like, with a pivot aperture 56A interposed between the head portion 52A and the tail portion 70A. In all other respects, the second embodiment shown in FIGS. 3 and 4 operates identically to the embodiments shown in FIGS. 1 and 2.

The foregoing has described an improved marine type anchor which substantially reduces the number of parts and the complexity of construction of the prior art anchor. The incorporation of the novel anchor crown means eliminates the need for sub-assemblies while still maintaining the true function of the anchor crown. The present invention enables the budget minded consumer to purchaase a true stock stabilized pivoting fluke type anchor.

The present disclosure includes that contained in the appended claims as well as that of the foregoing description. Although this invention has been described in its preferred form with a certain degree of particularity, it is understood that the present disclosure of the preferred form has been made ony by way of example and that numerous changes in the details of construction and the combination and arrangement of parts may be resorted to without departing from the spirit and scope of the invention.

Now that the invention has been described:

What is claimed is:

1. An improved marine anchor for anchoring a marine vessel with an anchor rode comprising in combination:

a first and a second fluke;

an anchor stock;

means connecting said first and second flukes to said anchor stock with a space disposed between said first and second flukes;

an anchor shank having a pivot aperture disposed between a head portion and a tail portion of said anchor shank;

rode means for connecting the anchor rode to said tail portion of said anchor shank;

said pivot aperture pivoting said anchor shank on said anchor stock in said space between said first and second flukes;

anchor crown means comprising a unitary member having a first and a second bend defining a first and a second end region angularly disposed relative to a central region;

an anchor crown slot defined by said central region of said anchor crown means extending between said first and second end regions;

means connecting said anchor crown means for movement with said first and second flukes with said central region of said anchor crown means contacting said anchor stock and with said first and second end regions extending in a direction generally opposite to the direction of said flukes and with said anchor stock being disposed between said first and second end regions; and said anchor shank extending through said anchor crown slot enabling said anchor shank to pivot from a first position in which said anchor shank head portion engages said first end region of said anchor crown means to a second position in which said anchor shank head portion engages said second end region of said anchor crown means.

2. An improved marine anchor as set forth in claim 1 wherein said anchor crown slot limits the lateral movement of said anchor shank on said anchor stock.

3. An improved marine anchor as set forth in claim wherein said rode means comprises a rode aperture disposed in the distal end of said tail portion of said anchor shank.

4. An improved marine anchor as set forth in claim 1 wherein said anchor shank includes a shank slot extending along the longitudinal length of the tail portion of said anchor shank; and said rode means comprises a rode fastener slidably engaged with said shank slot for receiving the anchor rode.

5. An improved marine anchor as set forth in claim 4 wherein said rode means comprises a ring slidably received in said shank slot of said anchor shank.

6. An improved marine anchor for anchoring a marine vessel with an anchor rode comprising in combination:

a first and a second fluke;

an anchor stock;

means connecting said first and second flukes to said anchor stock with a space disposed between said first and second flukes;

an anchor shank having a head portion and a tail portion comprising a shank rod having a first and a second end with a substantially one hundred and eighty degree bend at said tail portion;

said one hundred and eighty degree bend of said shank rod forming a first and a second leg;

first means interconnecting said first and second ends of said shank rod creating said head portion of said anchor shank;

second means interconnecting said first and second legs of said shank rod forming a pivot aperture between said first and second interconnecting means of said shank rod;

rode means including a ring slidably received between said first and second legs of said shank rod for connecting the anchor rode to said tail portion of said anchor shank;

said pivot aperture pivoting said anchor shank on said anchor stock in said space between said first and second flukes;

anchor crown means comprising a unitary member having a first and a second bend defining a first and a second end region angularly disposed relative to a central region;

an anchor crown slot defined by said central region of said anchor crown means extending between said first and second end regions;

means connecting said anchor crown means for movement with said first and second flukes with said central region of said anchor corwn means contacting said anchor stock and with said first and second end regions extending in a direction generally opposite to the direction of said flukes and with said anchor stock being disposed between said first and second end regions; and said anchor stock extending through said anchor crown slot enabling said anchor shank to pivot from a first position in which said anchor shank head portion engages said first end region of said anchor crown means to a second position in which said anchor shank head portion engages said second end region of said anchor crown means.

7. An improved marine anchor for anchoring a marine vessel with an anchor rode comprising in combination:

a first and a second fluke;

an anchor stock;

means connecting said first and second flukes to said anchor stock with a space disposed between said first and second flukes;

a utility anchor shank having a pivot aperture disposed between a tail portion and a head portion of said anchor shank;

rode means for connecting the anchor rode to said tail portion of said anchor shank;

said rode means comprising a rode aperture disposed in the distal end of said tail portion of said anchor shank;

said pivot aperture pivoting said anchor shank on said anchor stock in said space between said first and second flukes;

anchor crown means comprising a unitary member having a first and a second bend defining a first and a second end region angularly disposed relative to a central region;

an anchor crown slot defined by said central region of said anchor crown means extending between said first and second end regions;

means connecting said anchor crown means for movement with said first and second flukes with said central region of said anchor crown means contacting said anchor stock and with said first and second end regions extending in a direction generally opposite to the direction of said flukes and with said anchor stock being disposed between said first and second end regions; and said anchor shank extending through said anchor crown slot enabling said anchor shank to pivot from a first position in which said anchor shank head portion engages said first end region of said anchor crown means to a second position to which said anchor shank head portion engages said second end region of said anchor crown means.

* * * * *